United States Patent [19]

Hoag

[11] 4,426,004

[45] Jan. 17, 1984

[54] TAMPER PROOF CONTAINER AND METHOD

[76] Inventor: Steve W. Hoag, 545 French St., Adrian, Mich. 49221

[21] Appl. No.: 442,552

[22] Filed: Nov. 18, 1982

[51] Int. Cl.[3] ..... B65D 49/12; B65D 85/56

[52] U.S. Cl. ..... 206/525; 206/634; 206/45.34; 206/807; 215/251; 215/252; 53/49

[58] Field of Search ..... 206/525, 807, 527, 634, 206/601; 215/251, 252; 53/49

[56] References Cited

U.S. PATENT DOCUMENTS

| | | | |
|---|---|---|---|
| 577,640 | 2/1897 | Bokelmann | 215/251 |
| 958,887 | 5/1910 | Parmele | 215/252 |
| 4,271,972 | 6/1981 | Thor | 215/251 |

*Primary Examiner*—William T. Dixson, Jr.

*Attorney, Agent, or Firm*—Cullen, Sloman, Cantor, Grauer, Scott & Rutherford

[57] ABSTRACT

A tamper proof container and method of enclosing a medicine bottle or the like. The container comprises top and bottom portions or enclosures, each having an end wall and a side wall permanently joined to and surrounding the end wall, and spaced frangible intermediate portions interconnecting the side walls, preventing opening of the container without breaking the frangible portions. The preferred embodiment may be integrally formed of heat fusible plastic, wherein the end walls comprise similarly configured coplanar portions and the side walls provide a hinge for joining the end wall portions. The medicine bottle or the like is received through the side wall and the side walls and end wall portions are then permanently fused, forming a tamper proof container.

10 Claims, 4 Drawing Figures

TAMPER PROOF CONTAINER AND METHOD

FIELD AND BACKGROUND OF THE INVENTION

The tamper proof container of the present invention may be integrally formed from heat fusible plastic and may be easily opened, but provides clear evidence of tampering.

There is a critical need for a tamper proof container for medicine bottles and the like, particularly capsules, which may be contaminated with poisonous substances. The preferred container must provide clear and unequivocal evidence of unauthorized entry, yet should be easily opened by the consumer, following purchase, and relatively inexpensive. Patent medicine bottles and the like are generally enclosed in a paper box, which may be easily opened and the medicine tampered with, without detection. The bottle is often sealed with a shrink fit or tape seal, however, the seal does not prevent unauthorized entry or tampering. A shrink fit seal may be replaced or repaired often without detection by the consumer.

Tamper proof containers, such as "bubble packs", have been utilized to limit theft, but such containers are purposely bulky and difficult to handle. The contents are enclosed in a clear "bubble" of thermal plastic, which is attached to or laminated in a large paper card. The plastic bubble is intentionally difficult to remove at the retail counter, however it is still possible to enter the plastic bubble and tamper with the contents, given time and patience. Moreover, bubble packs are difficult to handle or display in bulk and are not intended to prevent undetected entry after purchase, and the tampered container may then be replaced on the retail shelf.

The tamper proof container and method of the present invention solves the problems of the prior art by providing a relatively inexpensive container which provides clear evidence of tampering and which may be used in mass packaging of patent medicines and the like.

SUMMARY OF THE INVENTION

The tamper proof container of the present invention is particularly adapted for packaging medicine bottles and the like, however the container may be utilized to package any substance which is subject to tampering. The container includes a top and bottom portion or enclosures which may be of any suitable shape to receive and protect the contents. The bottom portion includes a bottom wall and a side wall permanently joined to the bottom wall, extending generally perpendicular thereto, and completely surrounding the bottom wall. The top portion similar includes a top wall and a side wall permanently joined to and surrounding the bottom wall. The side walls of the top and bottom portions are interconnected by spaced frangible connector portions, which prevent opening of the enclosure without breaking the frangible portions and which provide clear evidence of unauthorized prior entry into the container.

As described, the tamper proof container of this invention may be formed of heat fusible plastic, wherein the top, bottom and frangible intermediate portions are integrally formed. The container may also be formed from a clear plastic sheet, wherein the contents may be easily viewed, or the container may be formed of any suitable material, including paper. As described, the container may be of any suitable shape, including a right angled hexahedron or box-shaped, having four rectangular side walls and square or rectangular top and bottom end walls or cylindrical.

The preferred embodiment of the tamper proof container of this invention includes a side opening for receipt of a medicine bottle or the like. In the preferred embodiment, the end walls of the top and bottom portions are comprised of two similarly configured coplanar end wall portions and the side wall of each portion forms a hinge for joining the end wall portions after receipt of the medicine bottle. The side opening is defined by aligned openings in the side walls and the spaced edges of the end wall portions. The tamper proof container may thus be die formed from a single sheet of heat fusible plastic.

The preferred method of this invention thus includes die forming the enclosure, preferably from an integral sheet of heat fusible plastic, including the top and bottom portions or enclosures, each having end walls comprised of similar triangular or semicircular components joined to the side walls, wherein the side walls are interconnected by spaced frangible connector portions and the side walls form a hinge for joining the top and bottom end wall components. The medicine bottle or item to be protected is then disposed into the integrally formed container through the side opening. The container is then closed by rotating the end wall components about the side walls into contact, and the container is finally sealed, preferably by fusing the end wall components and side walls together. It will be understood that the tamper proof container of the present invention may be formed in a continuous operation in a heated die forming apparatus, making the invention particularly suitable for mass packaging.

The tamper proof container of this invention may thus be opened by the consumer by simply twisting one enclosure portion relative to the other, breaking the frangible intermediate or connector portions between the side walls. Because the connector portions are integral with the side walls, the container portions cannot be reconnected, providing clear evidence of entry into the container.

The tamper proof container of this invention also resists opening by small children unable to relatively twist the top and bottom portions, depending upon the size of the container and the material from which it is formed.

The tamper proof container is relatively inexpensive and may be the same size as the present boxes used to contain patent medicines. No special handling is required, particularly where the medicine bottle is the same height as the enclosure, eliminating the requirement for the bulky card of bubble packaging. Other advantages and meritorious features of the present invention will be more fully understood from the following description of the preferred embodiments and the drawings, a brief description of which follows.

DESCRIPTION OF THE PREFERRED EMBODIMENTS AND METHOD OF THIS INVENTION

Figure 1:
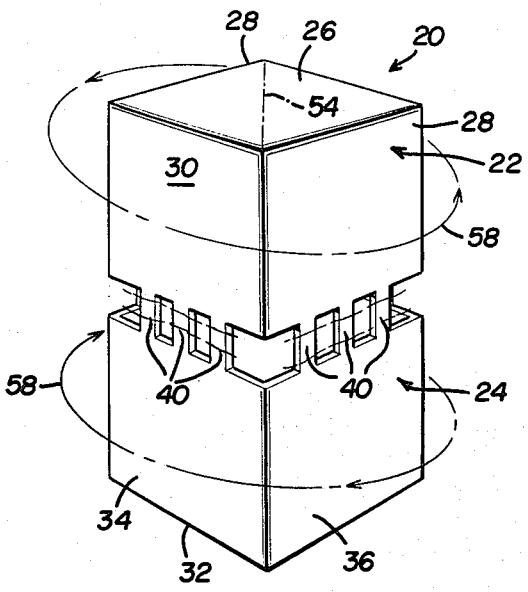
FIG. 1 is a side elevation of one embodiment of the tamper proof container of this invention.

The embodiment of the tamper proof container 20 shown in FIG. 1 includes a top portion or enclosure 22 and a bottom portion or enclosure 24. The top portion 22 includes a top or end wall 26 and opposed pairs of side walls 28 and 30. The bottom portion or enclosure 24 includes a bottom wall 32 and opposed pairs of side walls 34 and 36. The side walls of the top and bottom portions are interconnected by frangible connector portions 40, which are preferably integral with the side walls 28, 30 and 34, 36.

The embodiment of the tamper proof container 20 shown in FIG. 1 is a right angled hexahedron, or box-shaped having four side walls, a top and a bottom wall. As described, the tamper proof container of this invention may be integrally formed from a single sheet of heat fusible plastic, such as clear polyethylene. Alternatively, the tamper proof container may be die cast from various plastic materials including polystyrene. It is also possible to form the tamper proof container from paper by more conventional methods. The die formed part which may be utilized to form the tamper proof container of FIG. 1 is illustrated in FIGS. 2 and 3.

Figure 2:
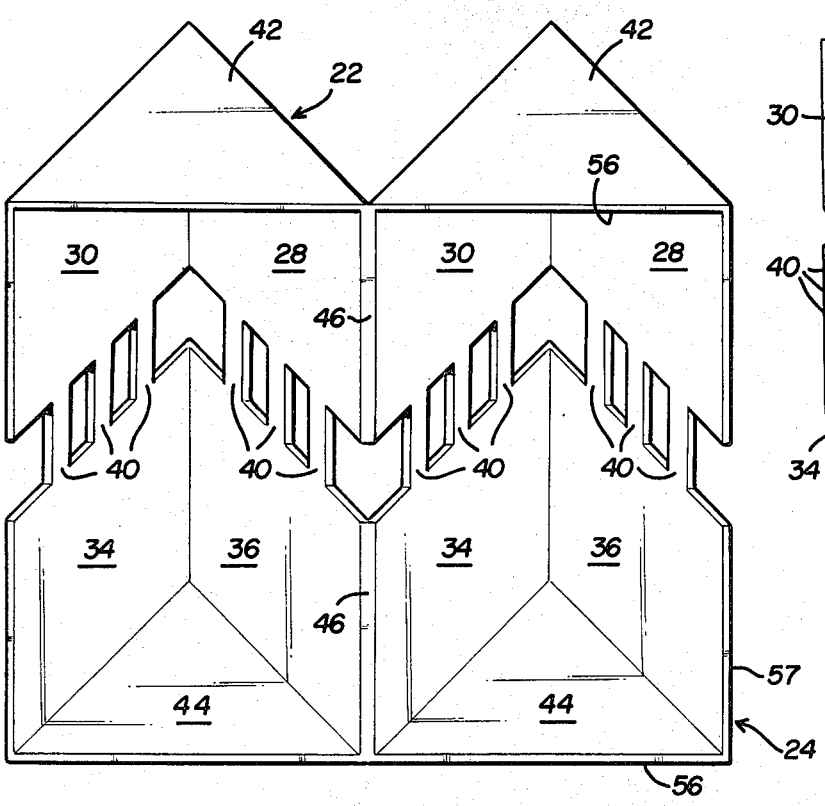
FIG. 2 is a front elevation of a die formed part which may be utilized to form the tamper proof container of FIG. 1.
Figure 3:
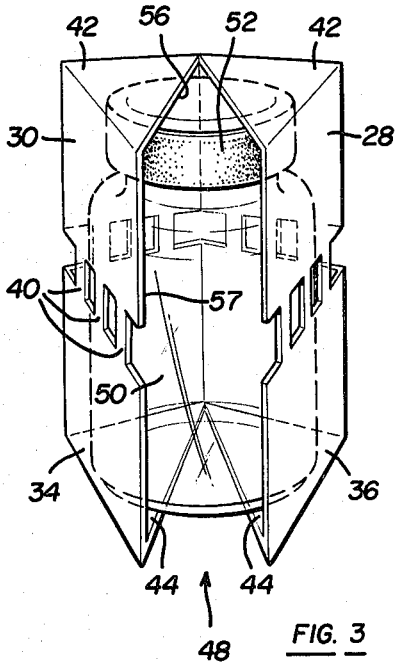
FIG. 3 is the die formed part shown in FIG. 2 illustrating the method of this invention; and, FIG. 4 is a second embodiment of the tamper proof container of this invention.

As best shown in FIG. 2, the top and bottom end walls of the container are formed from identical triangular components 42 and 44, respectively. The top triangular components 42 are integral or permanently joined to side walls 28 and 30 and the bottom triangular portions 44 are integral or permanently joined to bottom walls 34 and 36. As described above, the top side walls 28 and 30 and the bottom side walls 34 and 36 are joined by frangible connector portions 40 which are preferably integral with the side walls. Where the tamper proof container is die formed, the frangible connector portions may be formed by stamping rectangular openings between the side walls, leaving the connector portions 40. As illustrated by comparing FIGS. 2 and 3, the juncture 46 of the side walls of the top portion, 28 and 30, and the bottom portion, 34 and 36, form a hinge for closing the container, as shown in FIG. 3. The container opening is thus defined by the opposed edges 56 of the triangular end portions 42 and 44 and the edges 56 of the side walls, as shown in FIG. 3. A medicine bottle 50 or other article to be protected is then disposed into the container through the opening 48 and the container is closed by rotating the end portions 42 and 44 about hinges 46 defined by the junction of the side walls, as described above. Finally, the edges 56 of the triangular end portions and the side edges 57 of the side walls are interconnected to form the tamper proof container of FIG. 1. In the preferred embodiment, wherein the tamper proof container is formed of heat fusible plastic, the edges are heat fused, as shown at 54 in FIG. 1.

The method of this invention thus includes die forming the container, preferably in a single piece, as shown in FIG. 2. As described, the die formed part includes top and bottom portions 22 and 24, each including an end wall comprised of similar coplanar components 42 and 44 joined to the side walls 28, 30 and 34, 36 and wherein the side walls are interconnected by integral spaced frangible connector portions 40. A medicine bottle 50 or other item to be protected is then disposed into the container through the side opening 48, which is defined by the opposed edges 56 of the end wall portions and edges 57 of the side wall portions. The container is then closed and sealed, preferably by heat fusing the opposed edges 56 of the top and bottom end wall components and the adjacent edges 57 of the side walls. It will be understood that the tamper proof container of this invention may be used to contain any item subject to tampering or contamination. The medicine bottle 50 shown in FIG. 3 is a conventional bottle having a cap 52.

The tamper proof container 20 of FIG. 1 can therefore be opened and the contents removed only by breaking the frangible connector portions 40. This may be accomplished by relatively twisting the top and bottom portions, 22 and 24 respectively, as shown by arrows 58. The broken frangible connector portions provide clear and unequivocal evidence of entry into the container, particularly where the frangible connectors are formed integrally with the side walls of the top and bottom portions. The frangible connector portions cannot be reconnected after opening the container, providing evidence of unauthorized entry into the container and eliminating undetectable tampering with the contents. The container may also be child resistant, depending upon the size of the container and the strength of the frangible connector portions.

Figure 4:
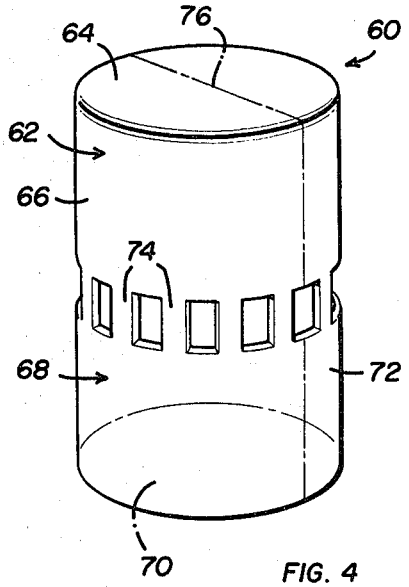

As described above, the tamper proof container of this invention may be formed in any suitable shape for ease of handling and to protect the contents. FIG. 4 illustrates an alternative embodiment of a tamper proof container 60, which is generally cylindrical in shape. The tamper proof container of FIG. 4 includes a top portion 62 having a circular top or end wall 64 and a cylindrical side wall 66 integral or permanently affixed to and extending perpendicular from the top wall 64. The bottom portion 68 similarly includes a circular bottom wall 70 and a cylindrical side wall 72. As described above in regard to FIGS. 1 to 3, the side walls 66 and 72 are interconnected by spaced frangible connector portions 74, which are preferably integral with the side walls. The cylindrical tamper proof container shown in FIG. 4 may be formed by the method described in regard to FIGS. 2 and 3, wherein the top and bottom walls are formed of semicircular components which are permanently joined or heat sealed along seam 76. The tamper proof container of FIG. 4 is opened in the same manner as described in regard to FIG. 1, wherein the top portion 62 is twisted or rotated relative to the bottom portion 68, breaking the frangible connector portions. The box-shaped container of FIG. 1 is however easier to form and has several advantages over cylindrical or other shaped containers, including ease of handling, packaging and improved child resistance. It will be understood, however, that various modifications may be made to the tamper proof container and method of this invention without departing from the purview of the appended claims, which follows.

I claim:

1. A tamper proof container for medicine bottles and the like, comprising:

a bottom portion having a bottom wall and a side wall permanently joined to said bottom wall extending generally perpendicular thereto and completely surrounding said bottom wall, a top portion having a top wall and a side wall permanently joined to said top wall extending generally perpendicular thereto, completely surrounding said top wall and spaced from said bottom portion side wall, and spaced frangible intermediate portions interconnecting said top and bottom portions side walls preventing opening of said enclosure without breaking said frangible intermediate portions and providing evidence of entry into said container.

2. The tamper proof container defined in claim 1, characterized in that said container is integrally formed of heat fusible plastic, wherein said frangible intermediate portions are integral with said side walls.

3. The tamper proof container defined in claim 2, characterized in that said container is formed of a clear plastic sheet, wherein the contents may be easily viewed.

4. The tamper proof container defined in claim 2, characterized in that said container walls, including said top and bottom walls and four side walls of said top and bottom portions, are rectangular and said top and bottom walls are formed of triangular portions fused together along the hypotenuse of said triangular portions.

5. The tamper proof container defined in claim 2, characterized in that said container is cylindrical with circular top and bottom walls, wherein said top and bottom walls are formed of semicircular portions fused along the straight edges.

6. A tamper proof container for medicine bottles and the like, comprising: top and bottom portions each having an end wall comprised of two similarly configured coplanar end wall portions adapted to be permanently joined to form said end container end walls, side walls permanently affixed to said end wall portions extending generally perpendicular thereto, surrounding the side unjoined edges of said end wall portions, forming a hinge for joining said end wall portions and having an opening at the unjoined edges of said end wall portions forming a side opening in said container, and an intermediate portion comprised of a plurality of spaced frangible connector portions permanently affixed to an interconnecting said top and bottom portions side walls forming a frangible barrier to entry to said container.

7. The tamper proof container defined in claim 6, characterized in that said container is integrally formed of heat fusible plastic, wherein said top and bottom portion end and side walls and said spaced frangible connector portions are integral.

8. The tamper proof container defined in claim 7, characterized in that said container is formed from a clear plastic sheet, wherein the contents may be easily viewed.

9. The tamper proof container defined in claim 6, characterized in that said end walls are rectangular and said end wall portions are triangular, said side walls of said top and bottom portions each including four rectangular side walls.

10. A method of forming a tamper proof container for a medicine bottle or the like, comprising the following steps:

die forming in a single integral piece an enclosure of heat fusible plastic having top and bottom portions, each including an end wall and a side wall, said end walls each comprised of similar coplanar components joined to said side walls, said side walls extending generally perpendicular to said end walls and forming a hinge for joining said top and bottom end wall components and having an opening aligned with the unjoined edges of said top and bottom end wall components forming a side opening to said container, and spaced frangible connector portions integral with and connecting said top and bottom side walls, disposing the item to be protected in said container through said side opening, and closing said container about the hinge formed by said side walls and heat fusing said top and bottom end wall components and said side walls, forming an enclosure with said frangible connector portions preventing entry into said container without breaking said frangible connector portions and providing evidence of entry of said enclosure.

* * * * *